United States Patent [19]

Sovik

[11] Patent Number: 5,051,026

[45] Date of Patent: Sep. 24, 1991

[54] CONTROLLED DENSITY PAVING AND APPARATUS THEREFOR

[75] Inventor: Robert A. Sovik, Clifton Park, N.Y.

[73] Assignee: AW-2R, Inc., Clifton Pk., N.Y.

[21] Appl. No.: 567,930

[22] Filed: Aug. 15, 1990

[51] Int. Cl.[5] ..... E01C 19/22; E01C 11/28; E01C 5/00

[52] U.S. Cl. ..... 404/118; 404/98; 404/73

[58] Field of Search ..... 404/87, 89, 96, 98, 404/118

[56] References Cited

U.S. PATENT DOCUMENTS

| | | | |
|---|---|---|---|
| 4,068,969 | 1/1978 | Beach et al. | 404/98 |
| 4,856,932 | 8/1989 | Kraft | 404/118 |
| 4,869,618 | 9/1989 | Morrison | 404/118 |

*Primary Examiner*—Ramon S. Britts
*Assistant Examiner*—Nancy P. Connolly
*Attorney, Agent, or Firm*—Schmeiser, Morelle & Watts

[57] ABSTRACT

Obtainment of and control of specific asphalt paving densities during roadbed repair by preshaping hot mat top surfaces prior to compaction. Like a shaped munition charge, a preshaped top surface on recently laid hot asphalt mat transmits compaction forces in precalculable directions and carries therewith asphaltic materials so as to obtain desired finished paving densities. A conventional strike off bar is modified with base margin indentations which partially and wholely, according to desired specifications, grade or top dress hot asphaltic mat with desired, force-transmitting planes. Adjunct apparatus is employed by way of translating and rotating plates to partially or wholely cover the indentations so as to effect various, but differing, desired mat surface shapes. An improvement to the conventional vibrating screed is also employed to shape the initial asphaltic mat shape while simultaneously tamping the shape gradually into its desired and compacted final form. This conforming screed is used with the modified strike off apparatus and a roller compactor or may be used in lieu of either.

1 Claim, 3 Drawing Sheets

CONTROLLED DENSITY PAVING AND APPARATUS THEREFOR

FIELD OF THE INVENTION

This invention relates generally to improved apparatus and novel methods for paving surfaces with asphalt and similar plastic compositions. More specifically, it deals with problems encountered in the repair of roadways which have been constructed of asphaltic materials in the last 80 years and offers a cure for the problem of mismatched density repairment that leads to rapid and ultimate erosion of repaired surfaces. Thus, the instant invention teaches with particularity the concept of roadway repair as a distinct and separate discipline from that of conventional roadway construction.

BACKGROUND OF THE INVENTION

The major problem in asphalt roadway repair is the current inability of the workers to obtain sufficient density and a proper seal upon joining new with old paving. Generally, road repairs are done on a piecemeal basis comprising merely filling existing holes with a hot mix (asphalt composition), and compacting immediately thereafter, either manually or with a roller or tamping mechanism. Such an operation is generally performed without concern or regard to several factors which are not merely important, but rather critical in effecting a sound patch or repair. Firstly, the morphology or shape of the surface to be joined—generally the slopes of the hole, is never addressed; and secondly, the density of the material left in the hole after compaction is rarely of concern. Where repair to be performed is a repair of a significant length of roadway, say the wheel rut areas which are cross-sectionally characterized as being most dense generally in the center of a rut and least dense at the outer crests (including significant cracking and spalling), the currently used repaving methods are totally unsatisfactory.

Current teachings, typified by the patent issued to Bruns in 1982 (U.S. Pat. No. 4,364,690), attempt to solve the aforementioned problem, namely repaving an old road pavement which has been damaged by tracks or depressions worn therein. Unfortunately, there is no philosophical development as to techniques that could be used to effect a proper and controlled asphalt density after compaction; but rather, all of the patentee's attention is dedicated to the top dressing which is screeded to essentially emulate a mirror image of the damaged roadway surface. In other words, where Bruns observes a depression, he compensates by building a mound of asphalt; and where he observes generally intact paving, he lays down a mat of essentially uniform thickness and density. The most severe handicap to this method occurs when the freshly and still plastic mat is subject to a tamping form of compaction or a simple rolling compaction, because the tendency is for the higher piles of asphalt (the mounds) to be extruded and translated horizontally (and literally) past the sides of the roller or tamping mechanism. Finally, a second notable shortcoming of the Bruns methodology is the paucity of teaching regarding the case which he addresses, but never fully makes—that of fully developing a compaction philosophy that will result in a controlled density paving, thereby avoiding a repetition of the rutting that his process was initially meant to cure.

It is interesting to note that in 1980, Bruns' predecessor in the art, Lanker, was issued U.S. Pat. No. 4,181,449 for his teaching of a method and apparatus employed on a conventional paver for making a tapered joint between adjacent paved sections. Lanker generally employs a paver apparatus that comprises the modern vibratory screed. Lack of an in-depth development of compaction theory is noted in this patent; but, it is interesting for its attempt to depart from the conventional, vertical longitudinal joint between pavement sections. From his disclosure, Lanker takes note of the density differences before various cross-sectional profiles of plastic asphalt are compacted; but, he fails to go further and relate properly the relative densities of compacted material that are realized immediately after the compaction of different cross-sectional thicknesses and shapes. On the other hand, I have noted such differences after many years of thoroughly analyzing newly repaired or newly paved roadways which appeared to fall into acute disrepair. Quite unexpectedly, I discovered that the density acquired on a newly paved or repaired roadway section was determined not only by the amount of material mounded over the area to be paved or repaired, but responded in a most significant manner to the morphology of the top dressed and newly laid down material. Thus, I have improved upon the observations and techniques of Lanker, while avoiding the limitations in the teachings of both him and Bruns. I am able to compensate and provide a controlled density "patch" for rather extensive lengths of roadway, irrespective of whether the joint achieved is on a vertical or inclined joint. Most importantly, I have developed a methodology which flies in the teeth of conventional repaving and road maintenance techniques. In order to introduce my ideas in a technique I term Controlled Density Paving (CDP), it was necessary for me to develop specialized apparatus which, in spite of the fact that it is substantially different and used for applying my new paving techniques, appears in many respects conventional. I rely on the vibratory screed for initial tamping and, if the top dressing of the newly laid down mat is made with close attention given to the details which I inculcate herein, perhaps the only tamping or compacting that will be required in the general repaving scheme. In cases where the vibratory screed is not sufficient for imparting the desired degree of compaction to the plastic asphalt mat, secondary rolling may be performed in which the desired densities will be obtained, having been acquired because of the predesignated morphology that is set out in the top dressing of the newly laid mat. The other salient piece of conventional equipment is the strike off bar or plate which is used to give the initial profiling or top dressing to the newly laid mat. At this point, it should be pointed out to the reader that the generally accepted term "screed" is a bit different in the asphalt laying industry than it is in the concrete paving industry. In the latter, a screed is a straight plank or bar that is run over a freshly poured surface for the purpose of leveling the freshly poured concrete slurry and, somewhat like an initial "floating", draws the water to the surface for final finishing. In asphalt paving, the strike off bar serves a purpose somewhat like the concrete screed in that it serves to level or in some fashion shape (top dress) a mat. The asphalt paver screed, on the other hand, acts more like a tamper or initial compaction mechanism than it does a true screed, although it too can "float" the asphalt and fine aggregate. With these distinctions in mind, I would like now to direct the reader's attention to the most current piece of relevant art that I was able to discover after an exhaustive search of patent records in the United States Patent and Trademark Office.

Watkins was issued U.S. Pat. No. 4,842,441 in June 1989 for an APPARATUS FOR FILLING A TRENCH IN A PAVED SURFACE. This is essentially an improvement to machines for filling trenches in paved surfaces. A trench, such as that which might be effected between a paved (asphalt) road and a concrete curb is filled by the apparatus of Watkins using a vertically adjustable strike off plate (on a strike off bar) which is adapted to define a course level above or below that of the surrounding paved surface and which is used to lay down a window of paving material with a predesignated cross-sectional morphology calculated, when rolled, to fill two side mini trenches that have been created by intrusion of the paver's guide rails. A great deal of the Watkins teaching is dedicated to the type of equipment nuances that are necessary to effect the highly stylized cross-sectional profile of the asphalt window that is laid down to fill the existing trench between paving and curbside. His idea of employing plates of different sizes, attached to the strike off bar, to effect mini trenches along the sides or joints of the major trench, is highly innovative; but the plates do not lend any definition to the mat profile such that, when rolled or compacted, a controlled density of the finished mat will have been achieved. It is clearly evident from a reading of the Watkins disclosure that, although his apparatus clearly suits the purpose for which it was intended, it cannot rise to the level of performance needed to perform my advanced and novel Controlled Density Paving methodology. It is for this reason, that I have had to depart significantly from conventional teachings, with the hereinafter disclosed screed and strike off bars.

SUMMARY OF THE INVENTION

By way of analogy, my method of Controlled Density Paving (CDP) may be likened to the use of shaped munition charges for anti-armour warfare. It is commonly known, and well accepted, that if a certain shape is lent to a munition charge, detonation at certain points of the charge will result in vectoral forces, generated by rapid surface burning, converging at a specific location on an armour plate; forces that will literally pierce or peel away the armour protection. By shaping or top dressing a newly lain asphalt mat, in a fashion of intersecting planes, it is possible to direct the compacting or roller forces into desired directions (force vectors). To effect a proper top dressing, a road jointing or repair problem must be carefully studied. It may be necessary to anticipate one or more predispositions of surfaces that are to be repaired. The first can be characterized simply as the road "rut" repair situation, wherein a significant length of roadway bears depressions caused by wheel rutting. The second is a jointing situation wherein a hot mat (also referred to as plastic) is laid next to and joining a cold mat, i.e., a previously lain and compacted asphalt mat. The cold mat has an area contiguous its edge or margin that is of a much lower aggregate density than the major portion which is considered to be of proper density. This marginal low density or fall-over portion, because it is no longer plastic, must be dressed in some fashion so as to make a good joint with the hot mat to be lain. To achieve this dressing, I either compact the cold margin or, in certain situations mill the edge. The third situation contemplates the laying of a hot mat over an original road surface consisting of two or more different levels (bi-level road repair). Finally, a major situation that is akin both the rut repair and the old mat joinder is the situation in which a large fracture section appears in an old surface. I have found that by anticipating one of the aforementioned situations, it is possible, using my techniques of top dressing the hot mat prior to compaction, to effectively repair any asphalt road surface or join a new road surface thereto.

As will be detailed hereinafter, the invention top dressing comprises a shaping of the upper surface of the freshly laid hot mat so as to insure a proper vectoral distribution of compressive forces when a vertical roller or tamping force is applied to the freshly dressed surface. It is important to bear in mind that the tamping or compacting (by either vibratory screed or roller) is accomplished soon after the top dressing is completed. For this reason, I prefer the vibratory screed which, when used in conjunction with my innovative dressing technique and/or my conforming screed apparatus, will make for a more efficient secondary rolling.

An important adjunct to the method of CDP is the unique piece of equipment which I use to quickly effect the top dressing of a hot mat prepatory to the use of a conventional screed or my new conforming screed. In order to acquire the highly stylized intersecting plane shapes in the top dressing of a hot mat, I had to depart significantly from conventional teachings and the apparatus which is used to effect standard techniques. The first departure was the fabrication of a unique strike off bar. In the bottom margin of an otherwise unremarkable and conventional strike off bar of the elongate, rectangular planar type, I devised one or more indentations of a generally rectangular shape. Depending upon the desired morphology to be effected during the laying of a hot mat, the indentations are located at the edges or over the rut/crack areas of the prospective roadway. Thus, as the strike off bar is drawn across a distributed hot mat, it conforms the top surface to its indentation pattern by striking off the lower margin portions and allowing an excess to pass through the indentations. Depending upon the plane-intersecting shape that is to be acquired, the indentation areas of the strike off bar are further conformed to desired shapes by a clever arrangement of shaping plates which are either horizontally translatable along the strike off bar or located above the indentations, and rotatably positionable. The rotatably positionable plates are termed "indexing plates" because they may be literally indexed so as to present differing shaped margins over the indentations of the strike off bar.

In a similar departure from convention, I employ a vibratory screed which uses a "sculptured" plane to conform with the plane shapes usually effected by the indented strike off bar while simultaneously compacting the resultant planed surfaces to the desired flat plane of completed roadway.

By the following series of drawings and explanation, the reader shall understand the foregoing description and be able to acquire results that are significant improvements over those now being achieved in the asphalt paving industry. Other repair situations, as well as new roadway fabrication, may be readily entertained by use of the aforementioned techniques and apparatus. As will be apparent to those of ordinary skill, the four repair situations described herein, in conjunction with the unique apparatus suggested, may be readily extrapolated to cover the preponderance of repair or new road construction situations that may be encountered.

DETAILED DESCRIPTION OF THE PREFERRED EMBODIMENT

Control Density Paving (CDP) was developed as a result of my proposed solutions for two major problems in road rebuilding: (1) wheel rutting in asphalt roadways; and (2) cold paving joint density mismatch. The former, observable by anyone who has traveled an old asphalt road, needs little explanation. The latter, however, exemplifies one of the major problems in asphalt paving, either for overlay on old road or for a new road. It is basically the problem of obtaining sufficient density and a good seal at a paving joint between mat laydown (paving) passes. When making an adjacent pass (after the first paving pass), a cold joint is encounter. Because the edge of the initial paving pass (the hot, plastic mat) is not restrained during the rolling process, the material falls from the side, is less dense than the balance of the mat and has a rough texture. After it is joined by an adjacent pass, it is regularly observed that the joint between the two passes normally begins to separate within one year.

Although four situational paving exercises were briefly described in the Summary, they exemplify the general manner in which the two aforementioned problems are addressed with my CDP system. Generally referring to FIGS. 1–4, it may be seen that the rut or depression problem of FIGS. 1 and 3 are handled in a slightly different fashion than the jointing problems of FIGS. 2 and 4.

Figure 1:
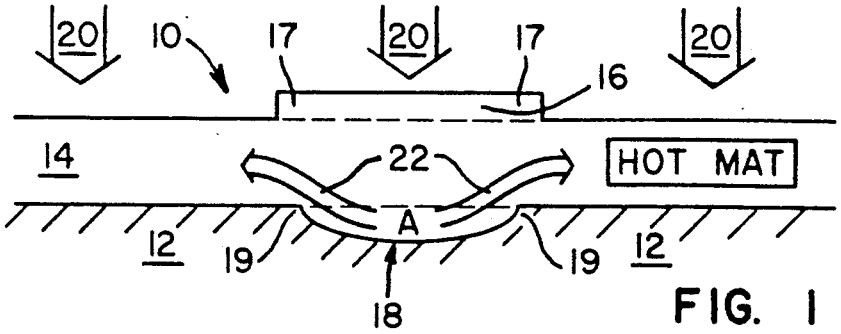
FIG. 1 is a cross-sectional profile of a rut repair mat.
Figure 2:
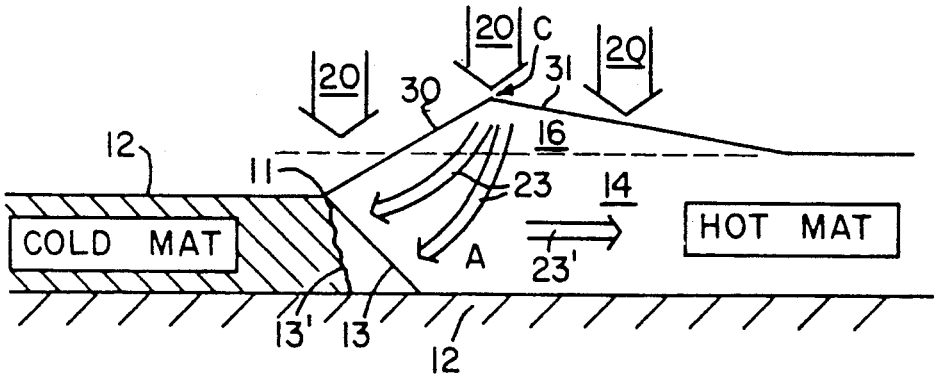
FIG. 2 is a cross-sectional profile of a hot mat-cold mat joint.

Referring more specifically now to FIG. 1, the transverse cross section of wheel rut repair 10 is shown in profile. Over an old mat 12 a hot plastic mat 14 is laid down with additional asphalt 16 supplied directly over the rut area 18, and extending beyond the rut edges or crests 19. Vertical compacting force 20 is then applied over the entire surface of the hot mat 14–16 as illustrated and the initial flow of the hot, plastic asphalt 16 commences downward in that general direction. As compaction increases, plastic asphalt material will tend to vent horizontally 22 into the hot mat 14. With this technique, maximum density in the rut area is assured. The overlapping margins 17 of excess mat 16 assure that, unlike the bulge or hump technique of earlier art, spill-over at the edges 17 of the excess material is held to a minimum and most of the compressive force is translated downward, to a point approximately indicated by A, before the sideway movement or extrusion begins.

Based upon an approximate 75% density of hot asphalt 14, the material at 16 must contain at least 25% of the unit length volume of the wheel rut area A. Calculations are trivial for paving routineers. Additional material is vented into the hot mat section so that the depth of the hot mat section adjacent to the depressed area should be at least one and one half times the size of the largest aggregate used in the paving mix. These empirically derived data indicate that for such rut repairing, the new hot mat may be relatively thin. Several methods have been attempted in order to minimize the problem of longitudinal joint separation, my solution to which is exemplified in FIG. 2. Some of the earlier methods have included pre-heating the joint just prior to the next paving pass or using a piece of equipment known in the industry as the "pizza cutter" to remove the less dense section and form thereby a vertical or undercut surface prior to the placing of the new hot mat. Although some improvement is obtained by these techniques, additional operations, equipment, material and time are required; but often the problem remains. The reason that the problem exists is because the material in the previous pass has not been confined during compaction and insufficient material is placed in the current pass to force the joint to properly close and provide sufficient density. I have discovered that by laying down a hot mat in sufficient quantity at the cold mat edge, the edge 13 of the cold mat 12 will absorb enough heat to become fairly plastic and that the "shaped" top dressing, when compacted, will confine and translate the compacting force into a direction that will also compact the cold mat edge 13 back to an area indicated 13'. The general shape of the top dressing is thus depicted in FIG. 2 cross-section as beginning at the planar intersection 11 of cold mat 12 and the original cold mat edge 13, rising as an (outside) edge plane 30 to a precalculated point C and then descending on a plane 31 to the precalculated level of hot mat 14. The inclined plane 30 precludes the generally equal compressive force 20 from extruding excess material 16 immediately toward the cold mat margin 11. The excess is calculated as above. During the compaction process, the main compactive forces 20 are translated by the planes 30, 31 into resultant vector forces 23 and as the shrinking (under compression) hot mat reaches a density near that of the cold mat and the mutual joint, the excess hot mat will begin to extrude horizontally 23' into the hot mat as the natural consequences of excape from confinement. Thus, attainment of the desired densities in both the cold and hot mats assures that the proper density has been obtained at the joint, the initial or original cold mat edge 13 has been effectively pushed into a more vertical profile 13', and there is no excess hot mat to spill over onto the cold mat at the joint 11.

Figure 3:
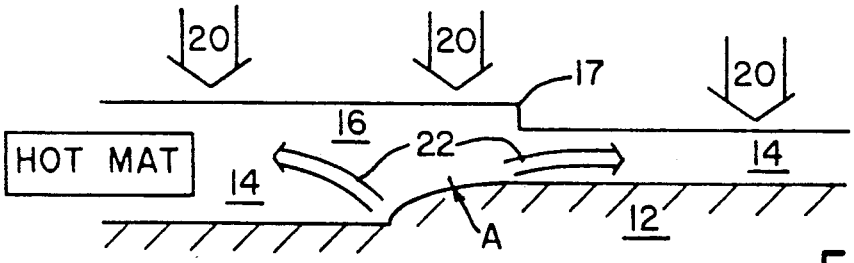
FIG. 3 is a cross-sectional profile of new paving on a bi-level roadway.
Figure 4:
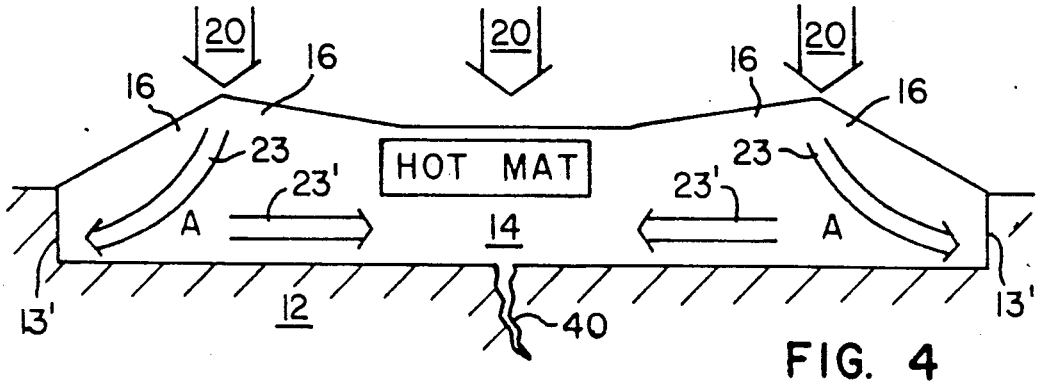
FIG. 4 is a cross-sectional profile of a fracture repair.

Relative to the third situation mentioned in the Summary, a repaving of a bilevel road surface is clearly depicted in FIG. 3. The incidence of the hot mat 14 vis-a-vis the cold mat 12 (or old road surface) are nearly identical to those discussed in FIG. 1. Likewise, FIG. 4 bears similar incidents to the jointing problem solved with the FIG. 2 shaping process. A notable difference in the FIG. 4 joint repair process is that I have shown a deliberately milled edge. This is, of course, the fastest way to acquire the highest density of the hot mat at the edge of the old mat. Furthermore, in cases where the fracture at a deteriorating joint moves deeper into the old surface 40, the premilling of the old edge will assure that excess material and, to some extent free asphalt, will pass into the fracture section, making the hot mat-repaired section similar to the dental filling in a tooth and, concomitantly, securely positioned. Those familar with molding techniques will recognize the similarity here wherein an old mat 12 is conformed to a confinement or mold and receives therein a filling 14, which is then compacted or forced fully into the mold by some extrinsic compacting force 20. Because segregation (between the fine and course aggregates) can occur during paving, particularly in the mat extension areas, vibratory rolling (vibratory screed tamping) is desirable in order to obtain proper material distribution and density at the hot mat-cold mat interface.

Figure 5:
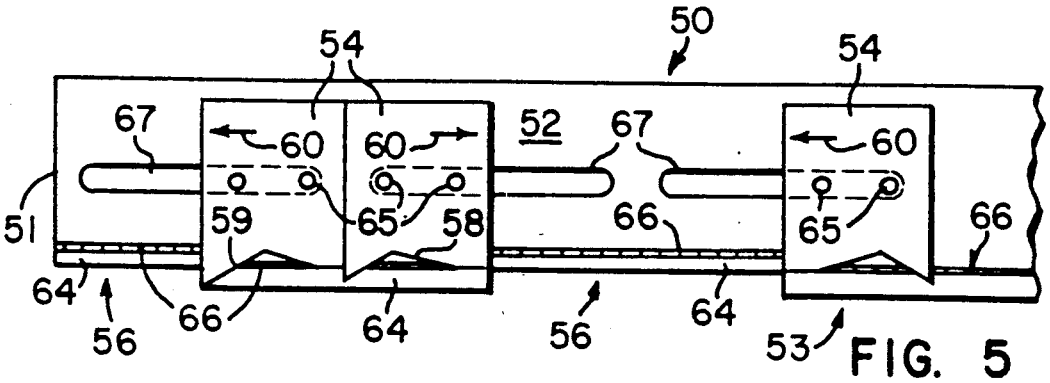
FIG. 5 is a front elevation of the invention strike off bar with translational plates retracted.
Figure 6:
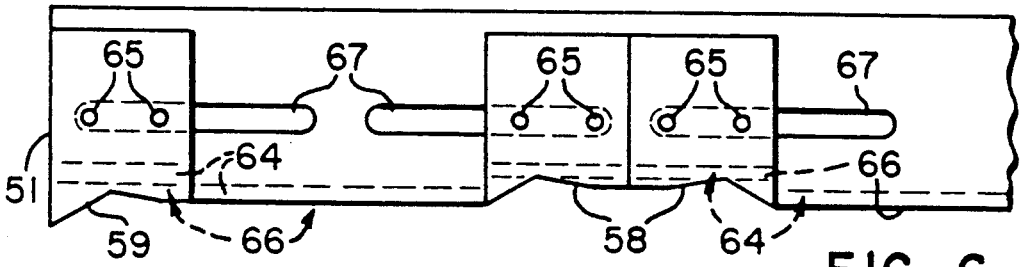
FIG. 6 is front elevation of the invention with translational plates covering indentations of the strike off bar.
Figure 7:
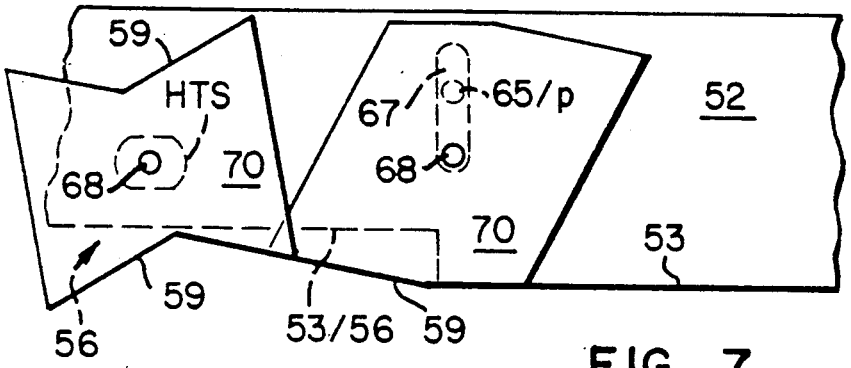
FIG. 7 is a partial front elevation of the invention strike off bar with edge indentation and indexable plates.

Having discussed the four basic techniques for acquiring high density, or more properly, Controlled Density Repair, I would like to direct the reader's attention to the apparatus which I have devised to readily effect the desired and various top dressings of my invention. At FIG. 5, there is illustrated, in frontal elevation, what I term the principal apparatus of the invention—the strike off unit 50, consisting of a strike off bar 52 and one or more strike off plates 54. It should first be noted that the strike off bar is an otherwise unremarkable elongate flat bar. However, essential to the invention is the one or more indentations 56 which are made in the bottom margin 53 of the bar 52, both at the edges 51 and interior thereof. It is the indentations 56 in their regular rectangular pattern that effect a strike off of newly lain hot mat with a remaining excess 16 as shown in FIGS. 1 and 3. Relative to the more stylized top dressing of FIGS. 2 and 4, translatable plates 54 have been individually furnished bottom margins 58, 59 which conform to the desired shapes of top dressings in FIGS. 2 and 4, and effect same when they are translated in the directions 60 shown herein. Likewise, if desired, translating plates of the type shown at the right hand side of FIG. 5, may be translated so as to bring their level margins over the indetentation 56 to effect a consistent and straight bottom margin 53 to the strike off bar 52. The mechanism for effecting the translation of the plates is unremarkable and within the capability of those having ordinary skill. Presently, I use a series of studs 65 on the plate reverse sides to fit into and slide along translating grooves 67 of the strike off bar 52. Reference to FIG. 5 clearly shows an element that is not quite apparent in FIG. 6, base filler plates 64, which are hinged 66. When attempting to effect the aforementioned top dressing styles, it is easier to work with strike off bar 52 apparatus that is multifunctional, i.e., versatile. The ability to readily change the definition of the bottom margin 53 exemplifies this feature. In the center of FIG. 7, note that plate 62 translates vertically on stud 65 and 65P in groove 67. This is a viable mounting translating alternative. The plates 54 and filler plates 64 are physically actuated by hydraulics or electrically driven screw mechanisms. Such driving devices are well known in the art and the reader is referred once again to the patent issued to Watkins in June 1989 which makes good use of the traditional adjusting screw mechanism.

Figure 8:
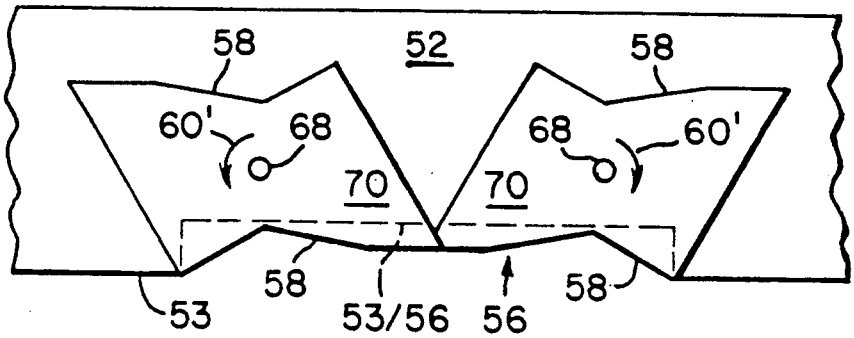
FIG. 8 is a partial front elevation of the strike off bar at the rut indentation with indexable plates.

The FIG. 7 alternate embodiment presents yet another apparatus which incorporates a novel feature of the invention. This embodiment requires no hinged filler plates 64. In place of the margin-altering apparatus, the strike off bar 52 bottom margin 53 is essentially as that described in FIG. 5. In this case, however, I employ rotating plates of various geometrical shapes to effect the total margin morphology necessary to incorporate the top dressings described in FIGS. 1–4. Referring specifically to FIG. 7, I have shown two rotatably indexible plates 70. Both use the stud-like posts of the above art with a difference that, in the preferred embodiment shown in the left plate, stud 68 is the drive shaft or rotary drive take-off of a high torque stepper motor (HTS). The right plate generally operates with the same motivation; but, for the edification of the reader, I have depicted the right plate with both the rotatable shaft 68 and, in dashed lines, the dual stud arrangement 65/P and 68 slidable in groove 67. This is done so that the reader may appreciate that slidable plates of but a single morphology may be used in situations that require less versatility and, consequently, lower equipment expenditures. The numerology in FIG. 7 otherwise corresponds to that of FIGS. 5 and 6. Likewise, FIG. 8 is merely an extrapolation of the FIG. 7 concept as it would appear over a more central indentation 56 in the strike-off bar 52. By utilizing the horizontal and/or vertical transation plates 54, rotatable plates 70 (with their highly controllable rotatability and indexing) and the various shapes that are conceivable, the routineer has been afforded a novel and most versatile means for top dressing a hot mat and for carrying out the basic methodology of the invention.

Figure 9:
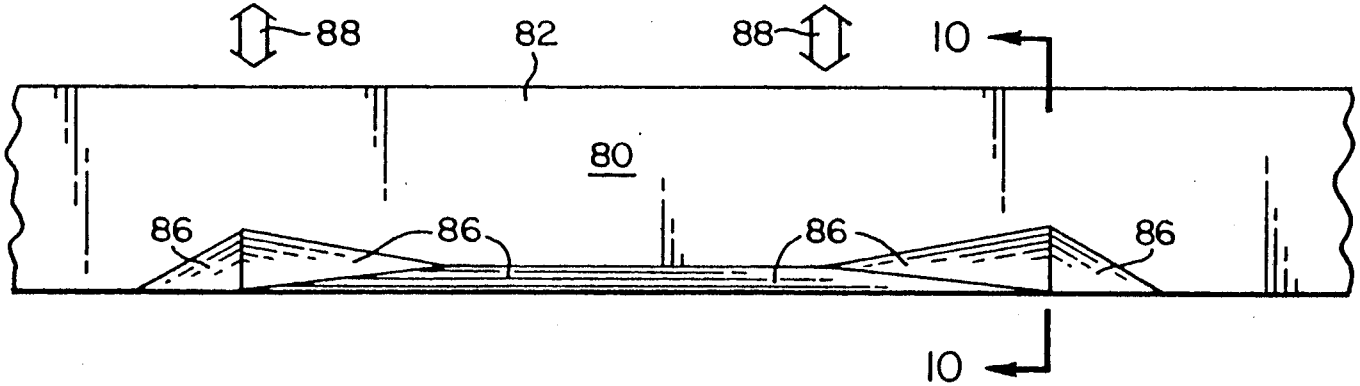
FIG. 9 is a front elevation of the conforming screed at a rut repair section.
Figure 10:
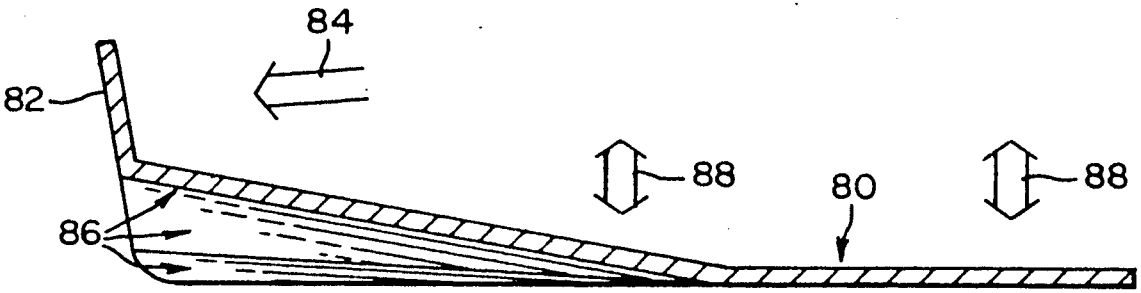
FIG. 10 is a cross-sectional side elevation of the FIG. 9 screed taken at 10—10.

Lastly, I provide an adjunct piece of equipment which, in certain types of paving repair, may provide all the dressing and tamping actually required to practice my invention. The reader is referred to FIG. 9 which discloses the front elevation of an ordinary vibrating screed. Such is well known in the industry and further exemplified in the aforementioned patent issued to Lanker in 1980. The section 10—10 taken from FIG. 9 is illustrated as a sectional side elevation in FIG. 10. Considering both FIGS. 9 and 10, there is illustrated a modified conventional screed 80. The face 82 of the screed is high enough to allow its "plowing" of the paving material laid down in front of it. The arrow 84 indicates its direction of travel as it slides over the freshly laid hot mat. FIG. 9 clearly illustrates an otherwise unremarkable forward edge, save for the relief 86 which the reader will recognize as a shape conforming to the FIG. 4 hot mat top dressing. The joint repair profile of FIG. 4 has the additional benefit of being the rut repair profile of FIG. 1, given certain circumstances. For this reason, I term this a conforming screed because, additional to the normal vibratory motion (indicated by arrows 88), it encounters ordinary hot mat, struck off in practically any shape including the FIG. 1 or FIG. 3 shapes, and conforms the top dressing to the FIG. 2 or FIG. 4 (or any requisite) shape while simultaneously tamping or compressing the mixture in conventional fashion. As mentioned earlier, certain operations may require nothing more than a conventional strike off bar, perhaps modified to my FIG. 1, FIG. 3 or similar bottom marginal shapes, which would effectively deposit gross amounts of the hot mat in front of a conforming screed 80. The face of the screed 82, in conjunction with the particular desired morphology 86 conforms the hot mat of various levels into the desired shape and, as it moves in the forward direction 84, vibrating (tamping) in the directions 88, it compacts the hot mass, through the desired shapes 86 into a mass of predetermined densities to the plane of a finished roadway.

It may now be seen that the incidents of my new CONTROLLED DENSITY PAVING system constitute a most notable advancement in the art. Furthermore, the unique implementing devices comprising a strike off bar with a predetermined base morphology, first and second alternate embodiments of the strike off bar comprising horizontally translating plates bearing alternately shaped base margins or power driven rotatably indexible plates with alternately shaped base margins, or both, and my novel conforming screed are of inestimable value in applying the instant concept for asphalt paving and, particularly, asphalt roadway repair.

What is claimed is:

1. A controlled density paving method comprising the steps of:

determining, prior to laying down a plastic compressible mat of asphalt, a mat top surface morphology defined by a plurality of acute angular planes for defining one or more discrete surface planes for receiving thereon and confining a vector compacting force emanating from each discrete plane and transmitting the compacting forces to predetermined locations in the mat proximate and thereover a selected roadbed portion, said determining comprising calculating which provides mat quantities relative to desired control of density to be exercised, depositing the mat on a roadbed portion while concurrently shaping it during said depositing, said shaping accomplished by selectively top dressing said roadbed portion as defined by the first step with calculated amounts of mat material so as to control the density of a mat resulting from simultaneously compacting the surface planes of the deposited mat; and compacting said mat after said shaping in order to create and urge various directional vector forces from said surface planes, said forces effecting a controlled density increase in said mat in said predetermined locations as determined by the calculating of said first step and the depositing of said second step.

* * * * *